United States Patent [19]

Farmer

[11] 4,198,727

[45] Apr. 22, 1980

[54] BASEBOARD DUSTERS FOR VACUUM CLEANERS

[76] Inventor: Gary L. Farmer, 11339 Buell St., Downey, Calif. 90241

[21] Appl. No.: 969,348

[22] Filed: Dec. 14, 1978

Related U.S. Application Data

[63] Continuation-in-part of Ser. No. 870,728, Jan. 19, 1978, abandoned.

[51] Int. Cl.[2] ..... A47L 5/22; A47L 9/06

[52] U.S. Cl. ..... 15/396; 15/364; 15/398; 15/400; 15/416

[58] Field of Search ..... 15/364, 367, 393, 396, 15/398, 400, 414, 415 R, 416, 195

[56] References Cited

U.S. PATENT DOCUMENTS

| | | | |
|---|---|---|---|
| 1,094,579 | 4/1914 | Matchette | 15/367 |
| 1,597,855 | 8/1926 | Zahorsky | 15/400 |
| 2,078,101 | 4/1937 | Schmermund | 15/367 |
| 2,860,367 | 11/1958 | Kolenda et al. | 15/400 X |
| 3,425,084 | 2/1969 | St. Laurence et al. | 15/195 |
| 3,533,120 | 10/1970 | Mercado | 15/50 A |
| 3,715,772 | 2/1973 | Downing et al. | 15/49 RB |
| 3,729,769 | 5/1973 | Sharpless | 15/414 X |

FOREIGN PATENT DOCUMENTS

| | | | |
|---|---|---|---|
| 251307 | 7/1948 | Switzerland | 15/364 |

*Primary Examiner*—Christopher K. Moore
*Attorney, Agent, or Firm*—John T. Matlago

[57] ABSTRACT

A vacuum cleaner is provided with holding devices on the sidewalls of its housing on which brushes can be mounted which enable baseboards in a room to be dusted while the vacuum cleaner is being moved about to clean the carpet.

12 Claims, 15 Drawing Figures

13
14
10
17
12
20
25
35
22
26
22
16
15
16
25
35
23

28
26
3
3
30
27
27

33
33
26
27
30
27

33
33
26
27
28
27

7
34
35
36
37
7
39
39

35
36
34
37

39

35
36

38
37
38

41
25

12
19
35
36
26
37
33
20
40
31
30
22
23
15
39
16

46
50
45
49
48
34
37
35
36
15
47
39

BASEBOARD DUSTERS FOR VACUUM CLEANERS

This application is a continuation-in-part of copending application, Ser. No. 870,728, filed on Jan. 19, 1978 now abandoned.

This invention relates to attachments for vacuum cleaners and more particularly to baseboard duster brushes adapted to be attached to the sides of the housing of a vacuum cleaner.

In the process of cleaning, housewives are quite concerned about dusting the baseboards in a room. Heretofore, this has been usually accomplished by the use of a manually held cleaning cloth or brush. This is an awkward and tedious task for the housewife because of the need for bending down while moving along the baseboard which extends throughout most of the four sides of the room. It is thus seen that it would be highly desirable to provide brushes on the sides of the housing of a vacuum cleaner which can be employed to dust the baseboards as a normal part of the task of manipulating the vacuum cleaner to clean the carpet in a room.

Accordingly, one of the objects of the present invention is to provide brushes on the sidewalls of a vacuum cleaner housing for use in dusting baseboards in a room.

Another object of the present invention is to provide baseboard duster brushes which can be simply mounted on the sidewalls of an existing vacuum cleaner housing.

Another object of the present invention is to provide baseboard duster brushes that are shaped so that they can be readily inserted in and removed from holding devices provided on the sidewalls of the housing of a vacuum cleaner.

With these and other objects in view, the invention consists in the construction, arrangement and combination of the various parts of the device whereby the objects contemplated are attained as hereinafter set forth, pointed out in the appended claims and illustrated in the accompanying drawings.

In the drawings

Figure 1:
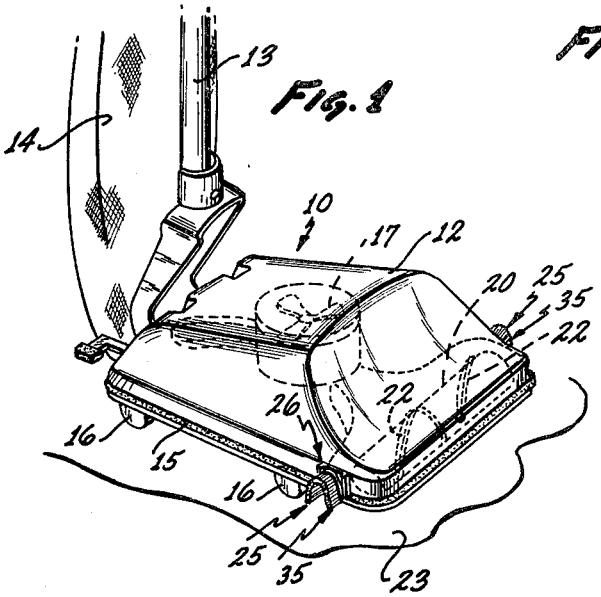
FIG. 1 is a perspective view of a typical vacuum cleaner showing the baseboard dusters of the present invention attached on the sides of its housing.
Figure 2:
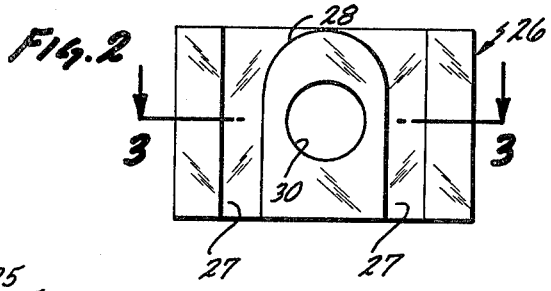
FIG. 2 is a front view of the holding device for the baseboard duster.

Referring to the drawings, a typical vacuum cleaner 10 is shown in FIG. 1. to include a housing 12 having an upright handle 13 with a bag 14 attached thereto. Support wheels 16 are rotatably mounted on the sides of the housing. Enclosed within the housing 12 is an electric motor driven suction fan or pump 17 together with passages for interconnecting a bottom inlet chamber 19 formed along the front end of the housing with the bag 14. Rotatably mounted within chamber 19 is a cylinder 20 having agitator bars 22 thereon which help to loosen dirt on the carpet 23 when the vacuum cleaner is being used. A strip of rubber guard 15 encircles the bottom end portion of the housing 12.

Figure 3:
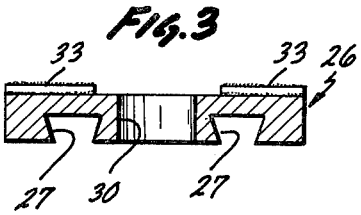
FIG. 3 is a sectional view of the holding device as taken on line 3—3 of FIG. 2.
Figure 4:
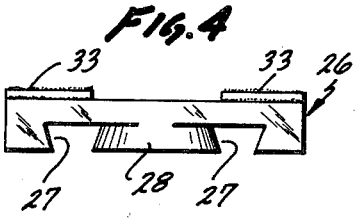
FIG. 4 is a top view of the holding device.

Attached on each of the front portions of the sidewalls of the housing 12 forming chamber 19 and just above the rubber guard 15 are the baseboard dusters 25 of the present invention. Each baseboard duster 25 includes a holding device 26 and a brush 35. As shown in FIGS. 3 and 4, each holding device 26 comprises a rectangularly shaped plate member having formed on its face portion a pair of vertically disposed grooves 27 which extend from the top to the bottom thereof. The grooves 27 form dovetail or undercut openings whose cross sections are trapezoidally shaped. The top corners of the inner walls of the grooves 27 are rounded so as to form a circular upper wall 28 of the face portion of the holding device 26. An opening 30 is provided through each holding device 26 centrally thereof between the grooves 27. The opening 30 is aligned with an opening 31 (FIG. 8) provided on the sidewall of the inlet chamber 19 just rearward of the cylinder 20.

The holding devices 26 are preferably securely mounted on the sides of the vacuum cleaner housing 12 by use of strips of doubled sided foam mounting tape 33 located on the sides of the back surface thereof. Alternately, the holding devices 26 may be mounted onto the sidewalls by use of screws. The holding devices 26 are preferably molded of plastic.

Figure 5:
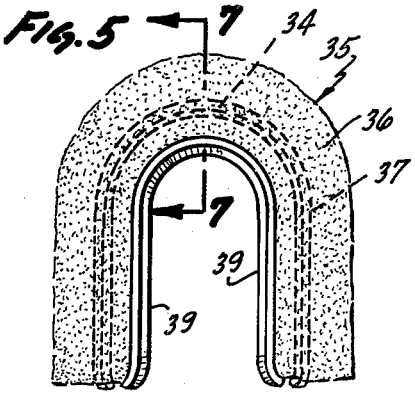
FIG. 5 is a front view of the brush for the baseboard duster.
Figure 6:
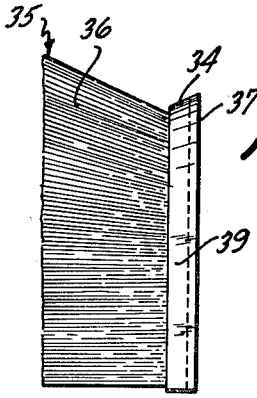
FIG. 6 is a sideview of the brush.
Figure 7:
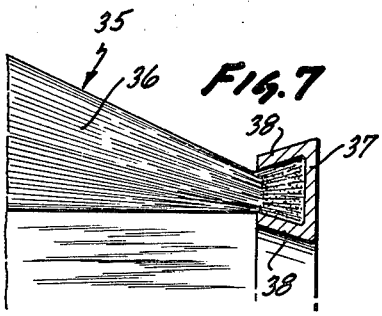
FIG. 7 is a sectional view of the brush as taken on line 7—7 of FIG. 5.

As shown in FIGS. 5, 6 and 7, each brush 35 is made by inserting the ends of relatively stiff short lengths of bristles 36 along the opening of a length of a rectangular metal channel from which the frame 37 is formed. The sides 38 of the channel upon being bent angularly inwardly serve to securely grip the ends of the bristles 36 and to provide the frame with a trapezoidally shaped cross section. The length of metal channel is then permanently bent along its length to form the inverted U shaped frame 37 having side legs 39 shaped to conform with the spacing of the pair of grooves 27 formed on the face portion of the holding device 26.

With the holding devices 26 securely mounted on the sidewalls of the housing 12 by use of the strips of tape 33, the trapezoidal cross sectionally shaped legs 39 of the frame 37 can be readily inserted, i.e., dovetailed down into the similarly shaped openings of the grooves 27 provided on the top of the face portion of the holding device 26. The frame 37 is then seated such that the inner curved top surface of the frame 37 contacts the curved top wall 28 on the holding device 26. The ends of the legs 39 of the inverted U shaped frame 37 preferably extend below the bottom of the holding device 26 and in front of the rubber guard 15 provided about the housing 12. It should be noted that when so mounted the bristles 36 extend laterally outwardly and fan out above and below the holding device 26 so as to be able to sweep over a large vertical area. This is important since baseboards come in various sizes and shapes.

Figure 8:
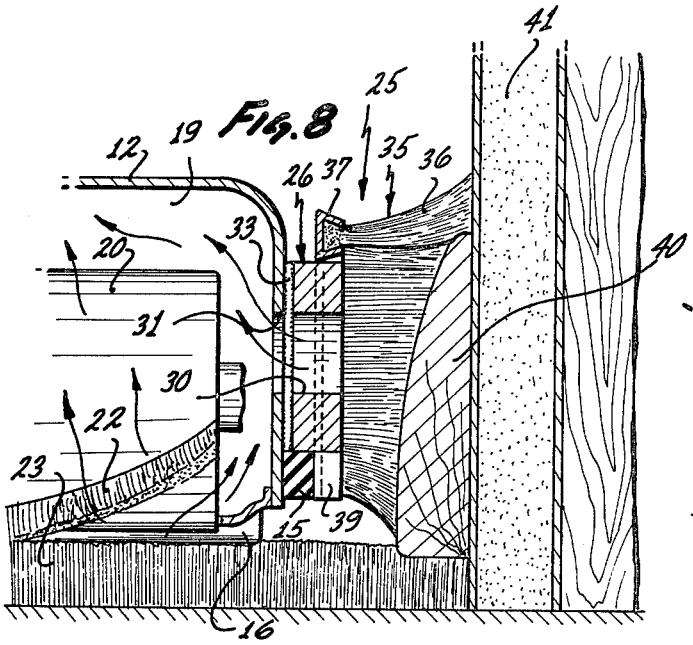
FIG. 8 is a sectional view showing the housing of the vacuum cleaner positioned such that the brush on the sidewall thereof can dust the baseboard in a room.

Now then, when either sidewall of the housing 12 of vacuum cleaner 10 is positioned adjacent a baseboard 40 in a room, as typically shown in FIG. 8, the bristles 36 of the brush 35 of the baseboard duster 25 can be readily pressed against the baseboard 40. Thus, whatever the size or shape of the baseboard 40, the bristles 36 conform to and sweep over the top and side surfaces thereof as the housing 12 of the vacuum cleaner 10 is being advanced parallel to the wall 41 in the course of cleaning the carpet 23. The outside air rushing into the partial vacuum created in the inlet chamber 19 by the suction fan 17 picks up the dust loosened by the brush 35 and carries it through the opening 30 of the holding device 26 and the aligned opening 31 in the sidewall of the housing 12 into the chamber 19. This dust along with the dust and waste picked up from the carpet 23 is then carried by the air past the suction fan 16 and up into the bag 14 attached to the handle 13 of the vacuum cleaner 10. Thus, the brushes 35 on the opposite sidewalls of the housing 12 provide for dusting the baseboard 40 while the adjacent area of the carpet 23 is being cleaned. It should be appreciated that the providing of brushes 35 on both the sidewalls of the vacuum cleaner housing 12 is of a great convenience for the housewife inasmuch as it enables her to manipulate the vacuum cleaner 10 during the process of vacuuming the carpet 23 in either direction along the baseboard 40 for the purpose of cleaning it.

Figure 9:
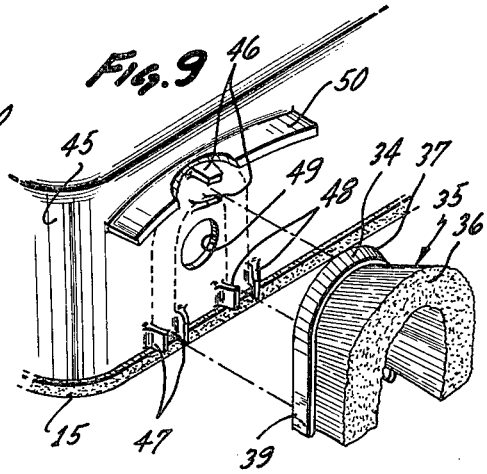
FIG. 9 is a modification showing pairs of projections molded on a side of a vacuum cleaner housing for engaging the frame of the baseboard duster brush.
Figure 10:
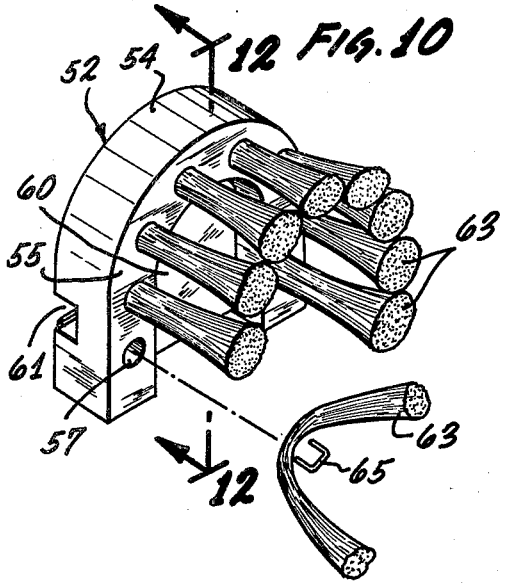
FIG. 10 is a front perspective view of another embodiment of the baseboard duster.
Figure 11:
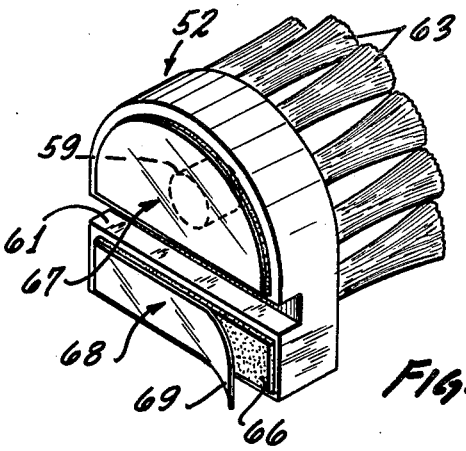
FIG. 11 is a back perspective view of the baseboard duster shown in FIG. 10.
Figure 12:
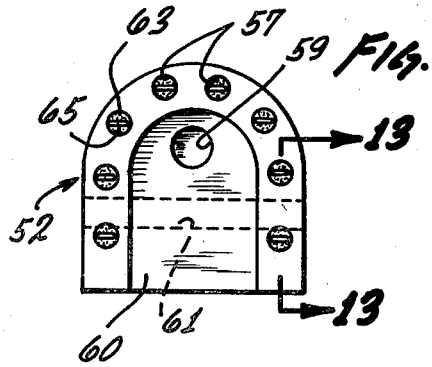
FIG. 12 is a front sectional view of the baseboard duster as taken along line 12—12 of FIG. 10.
Figure 13:
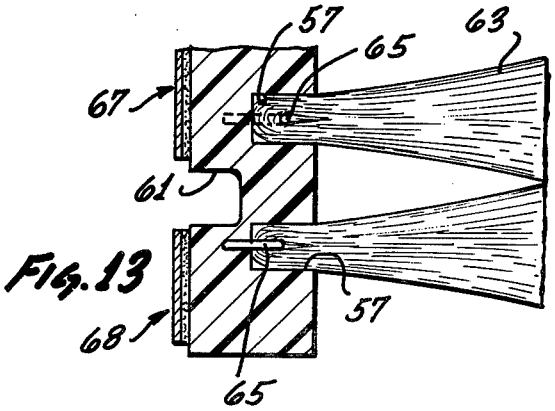
FIG. 13 is a partial sectional view as taken along line 13—13 of FIG. 12.

Reference will next be made to FIG. 9 which shows a portion of the plastic sidewall of a vacuum cleaner housing 45 molded with three pairs of spaced projections 46, 47 and 48 about an opening 49. The projections in each pair are angularly disposed toward each other and the pairs of projections, per se, are positioned and spaced relative to each other so as to engage the lower end portions of the respective legs 39 and the midportion 34 of the brush frame 37. The plastic material of which the pairs of molded projections 46, 47 and 48 are molded is sufficiently tough and resilient such that when the trapezoidally shaped cross section of the U shaped frame 37 is snapped in position between them, the brush 35 is firmly held in engagement therewith. A hood 50 may be molded above the upper pair of projections 46 to improve the appearance of the housing.

Reference will next be made to FIGS. 10–14 which show a further embodiment 52 of a baseboard duster for mounting on the sidewalls 71 of the housing 72 of an upright vacuum cleaner. The embodiment 52 includes a plastic molded body 54 having a rounded upper surface and formed with an inverted U projecting rim portion 55 on the front thereof. The body 54 has an opening 59 molded on the central wall 60 thereof and a horizontal groove 61 molded on the back thereof below the hole 59.

Spaced blind holes 57 are provided on the face of the projecting rim portion 55. Bristles 63 which may be formed of nylon are held in each of the blind holes 57 by a metal staple 65 which bears on the midpoint of a length of the bristles 63 upon being shot into the blind hole 57 so as to engage the bottom thereof. The lengths of bristles 63 are thus folded back on themselves and extend substantially laterally outwardly with their ends merging together to form a continuous brush extending about the rim portion 55 of the body 54.

Figure 14:
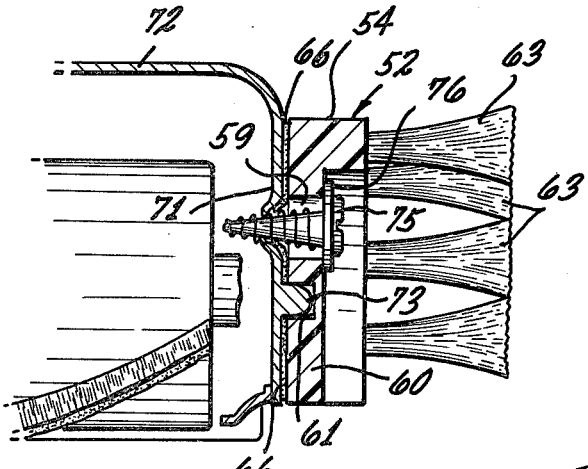
FIG. 14 is a sectional view showing the baseboard duster of FIG. 10 mounted on the sidewall of the housing of a vacuum cleaner.

Secured on the flat back wall of the body 54 and conforming with the respective areas above and below the molded horizontal groove 61 are strips 67 and 68 of double sided foam adhesive tape. The outer surface of the layer of foam adhesive 66 in each strip is covered with a liner 69 which is removed when the body 55 is to be mounted on the sidewall 71 of the housing 72 of an existing vacuum cleaner, as shown in FIG. 14. The horizontal groove 61 on the body 54 is fitted over a bead 73 provided on the sidewall 71 of the housing 72. In addition, a sheet metal type screw 75 provided with a washer 76 passes through the central opening 59 in the body 54 and threadably engages a small hole drilled in the molded sidewall 71. It should now be clear that the body 54 of the baseboard duster is securely held in position on the sidewall of the housing 72 by the strips 67 and 68 of foam adhesive tape, by the groove 61 on the body fitting over the bead 73 on the sidewall of the housing, and by the sheet metal type screw 75.

It should be appreciated that recessing the central portion of the body 55 minimizes the material needed to make the body 54. Further, providing bristles 63 only along the rim portion 55 of the body 54 minimizes tha amount of the bristles needed to form the brush and enables the dust on the baseboards to be swept free but not entrapped within the bristles of the brush.

The bristles 63 are sufficiently long enough so that they will readily spread out and conform with the contour of the baseboard as they are pressed thereagainst. Furthermore, the provision of long bristles ensures that during use of the baseboard duster no extra precautions are required to prevent the hard surfaces and edges of the molded body 54 from scratching or otherwise marring the surfaces of the baseboard or furniture that may be encountered.

Figure 15:
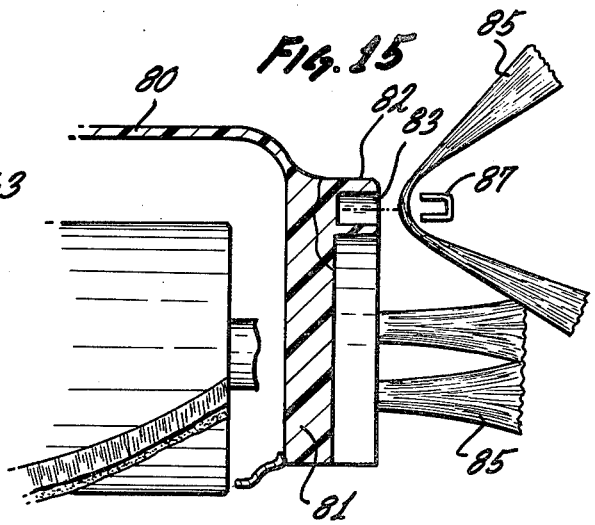
FIG. 15 is a modification showing the body of the baseboard duster of FIG. 14 molded as an integral part of the sidewall of the housing of the vacuum cleaner.

Reference will next be made to FIG. 15 which shows the body of the baseboard duster formed as an integral part of the sidewall of a molded vacuum cleaner housing 80. Thus, the housing 80 is molded with thickened pads 81 on the front sidewalls thereof adjacent the suction input. Each pad 81, as shown in FIG. 15, is provided with rim portion 82 in the form of an inverted U having spaced openings 83 on the face thereof. Lengths of bristles 85 are then folded and anchored by their midpoints in each of the openings 83 by a metal staple 87.

While the embodiments of the baseboard dusters shown and described herein are admirably adapted to fulfill the objects and advantages previously mentioned as desirable, it is to be understood that the invention is not limited to the specific features shown and described but that the means and configuration herein disclosed are susceptible of modification in form, materials, proportions and arrangements of parts without departing from the principles involved or sacrificing any of its advantages and the invention therefore may be embodied in various forms within the scope of the appended claims.

What is claimed is:

1. In a vacuum cleaner:

a housing having sidewalls;

holding means on each of the sidewalls having spaced dovetail openings; and a brush for mounting on each of said holding means, each said brush including bristles secured on an inverted U shaped frame having a dovetail cross section such that the legs of said frame are engageable into the correspondingly shaped openings on said holding means;

whereby said brushes are held with their bristles extending substantially laterally from the opposite sidewalls of the housing thereby enabling said brushes to be used to sweep across the baseboards while the vacuum cleaner housing is being moved about to clean the carpet in a room.

2. In a vacuum cleaner as defines in claim 1 wherein the dovetail openings of the holding means on the sidewalls are provided by three pairs of molded projections spaced for receiving the ends and midportion of said inverted U shaped frame.

3. In a vacuum cleaner as defined in claim 1 wherein the dovetail openings of the holding means on the sidewalls are provided by a pair of spaced vertically disposed grooves formed on the front of a plate secured to each of the sidewalls.

4. In a vacuum cleaner as defined in claim 3 wherein the upper inner corners of said grooves are rounded to form a circular upper wall on each said plate which engages the rounded midportion of said inverted U shaped frame when the brush is joined on said holding means.

5. In a vacuum cleaner as defined in claim 1 wherein said housing encloses a suction fan for drawing air from a bottom inlet chamber formed on the front end thereof into a bag held on a handle thereof, and wherein said housing has openings on its sidewalls forming the sides of said inlet chamber, whereby the dust on said baseboards loosened by the brushes can be drawn by the fan into said bag.

6. A vacuum cleaner including a housing enclosing a suction fan for drawing air from a bottom inlet chamber formed on the front end thereof into a bag held on an upright handle thereof, said housing having an opening on its sidewall forming a side of said inlet chamber, and including a baseboard duster attachment for said housing comprising:

a holding device in the form of a plate having a pair of spaced vertically disposed dovetail grooves formed on the front portion thereof with an opening therethrough between the grooves;

means for securing said holding device on the sidewall of said housing with its opening aligned with the opening thereon; and a brush including an inverted U shaped frame having its end formed with a dovetail cross section and spaced to correspond to the openings of the grooves on said holding device;

whereby the ends of said inverted U shaped frame can be inserted down into said respective grooves to form an interlocking dovetail joint between the brush and the holding device with the bristles of the brush extending substantially laterally from the sidewall of the housing thereby enabling said brush to be used to sweep across the baseboards while the vacuum cleaner is being moved about to clean the carpet in a room.

7. The vacuum cleaner as defined in claim 6 wherein a baseboard duster attachment is similarly provided on the opposite sidewall of said housing.

8. The vacuum cleaner as defined in claim 6 wherein the lower ends of the inverted U shaped frame extend below the bottom edge of the holding device and wherein the bristles fan outwardly above and below the holding device so as to sweep over a large vertical range.

9. In a vacuum cleaner:

A housing having sidewalls;

a holding means on each of the sidewalls, each said holding means including a vertically disposed inverted U shaped rim portion having openings along the front face thereof; and lengths of bristles held in said openings such that they extend substantially laterally from the sidewalls of the housing to form brushes having inverted U shaped configurations;

whereby said bristles can be used to sweep across the sides and upper edges of the baseboards of a room while the vacuum cleaner housing is being moved about to clean the carpet therein.

10. In a vacuum cleaner as defined in claim 9 wherein said openings along the inverted U shaped rim portion are spaced blind holes and wherein said lengths of bristles are held by their midpoints in said spaced holes by metal staples.

11. In a vacuum cleaner:

a housing having sidewalls;

a pair of holding means each comprising a body having an inverted U shaped rim portion with spaced openings on the front face thereof;

means for anchoring lengths of bristles in each of the spaced openings on the face of said U shaped rim portion to form a brush; and means for securing said holding means on the respective sidewalls of said housing such that the front faces of said inverted U shaped rim portions are disposed in vertical planes;

whereby said brushes are held with their bristles extending substantially laterally from the sidewalls of said housing thereby enabling them to be used to sweep across the sides and upper edges of the baseboards of a room while the vacuum cleaner housing is being moved about to clean the carpet therein.

12. In a vacuum cleaner as defined in claim 11 wherein said means for securing said holding means on the respective sidewalls of said housing include strips of adhesive tape on the back wall of said body and a hole in the center thereof to enable a screw to pass therethrough to threadably engage said sidewall.

* * * * *